US009417550B2

(12) United States Patent
Miyagawa

(10) Patent No.: US 9,417,550 B2
(45) Date of Patent: Aug. 16, 2016

(54) IMAGE FORMING APPARATUS THAT INDICATES OPERATING STATUS USING LUMINOUS BODY

(71) Applicant: KYOCERA DOCUMENT SOLUTIONS INC., Osaka (JP)

(72) Inventor: Tomoo Miyagawa, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 0 days.

(21) Appl. No.: 14/992,202

(22) Filed: Jan. 11, 2016

(65) Prior Publication Data

US 2016/0124340 A1 May 5, 2016

Related U.S. Application Data

(63) Continuation of application No. 14/635,016, filed on Mar. 2, 2015, now Pat. No. 9,268,278, which is a continuation of application No. 13/854,359, filed on Apr. 1, 2013, now Pat. No. 8,989,612.

(30) Foreign Application Priority Data

Apr. 4, 2012 (JP) ..... 2012-085335

(51) Int. Cl.

| | |
|---|---|
| ***G03G 15/04*** | (2006.01) |
| ***G03G 15/00*** | (2006.01) |
| ***F21V 9/00*** | (2015.01) |

(52) U.S. Cl.

CPC ..... *G03G 15/04036* (2013.01); *F21V 9/00* (2013.01); *G03G 15/50* (2013.01); *G03G 15/5016* (2013.01)

(58) Field of Classification Search

CPC ..... F21V 9/00; G03G 15/50; G03G 15/5016

See application file for complete search history.

(56) References Cited

U.S. PATENT DOCUMENTS

| | | | |
|---|---|---|---|
| 6,386,080 | B1 | 5/2002 | Okamoto et al. |
| 7,194,185 | B2 | 3/2007 | Watanabe |

FOREIGN PATENT DOCUMENTS

| | | |
|---|---|---|
| JP | 11161193 | 6/1999 |
| JP | 2000-280585 | 10/2000 |
| JP | 2002-040969 | 2/2002 |
| JP | 2002-156874 | 5/2002 |
| JP | 2003-094765 | 4/2003 |
| JP | 2003-098986 | 4/2003 |
| JP | 2006-246332 | 9/2006 |

*Primary Examiner* — David Bolduc

(74) *Attorney, Agent, or Firm* — K&L Gates LLP

(57) ABSTRACT

An image forming apparatus includes an image forming section, a body housing, a protruding housing, a light diffusing portion, a light source, a light guide path, and a control unit. The image forming section performs image formation on a sheet. The body housing is formed by a box body with a top surface, and contains the image forming section. The protruding housing is located on the top surface, and has a top portion protruding upwardly above the top surface. The light diffusing portion is located in or near the top portion of the protruding housing. The light source is located inside the body housing or the protruding housing, and emits light. The light guide path guides light emitted by the light source to the light diffusing portion. The control unit controls illumination of the light source based on the information related to the image formation.

19 Claims, 14 Drawing Sheets

IMAGE FORMING APPARATUS THAT INDICATES OPERATING STATUS USING LUMINOUS BODY

INCORPORATION BY REFERENCE

This application is a continuation of U.S. application Ser. No. 14/635,016, filed on Mar. 2, 2015, which is a continuation of U.S. application Ser. No. 13/854,359, filed on Apr. 1, 2013, now U.S. Pat. No. 8,989,612, which is based upon and claims the benefit of priority from Japanese Patent Application No. 2012-085335, filed on Apr. 4, 2012, the entire contents of each of which are incorporated herein by reference.

BACKGROUND

Unless otherwise indicated herein, the description in this section is not prior art to the claims in this application and is not admitted to be prior art by inclusion in this section.

The present disclosure relates to an image forming apparatus that indicates operating status using a luminous body.

In image forming apparatuses, such as printers, copiers, facsimiles, and multifunction peripherals that combine these capabilities, an apparatus is known which has an indicator for indicating status information of the apparatus to the user. The status information is, for example, information about the status of a connection with a local area network, the status of reception of image data from an external device, or occurrence of trouble in the apparatus, such as a sheet jam or running out of toner. The indicator is typically formed by a luminous body, such as a light emitting diode (LED). In accordance with the status information, the luminous body illuminates in a predetermined pattern. Viewing the illumination of the luminous body allows the user to recognize the status information of the image forming apparatus.

In such an image forming apparatus of the related art, an indicator indicating status information is positioned based on the assumption that it will be viewed from a specific direction relative to a main body of the apparatus. Since such an indicator has a low level of visibility from directions other than the specific direction, the user may not be able to recognize the status information. For example, if the luminous portion of the indicator is located at the front of the apparatus, the luminous portion cannot be clearly viewed from the side or back of the apparatus.

SUMMARY

An image forming apparatus according to an embodiment of the present disclosure includes an image forming section, a body housing, a protruding housing, a light diffusing portion, a light source, a light guide path, and a control unit. The image forming section is configured to perform image formation on a sheet. The body housing is formed by a box body with a top surface, and configured to contain the image forming section. The protruding housing is located on the top surface, and has a top portion protruding upwardly above the top surface. The light diffusing portion is located in or near the top portion of the protruding housing. The light source is located inside the body housing or the protruding housing, and configured to emit light. The light guide path is configured to guide light emitted by the light source to the light diffusing portion. The control unit is configured to control illumination of the light source based on the information related to the image formation.

Additional features and advantages are described herein, and will be apparent from the following Detailed Description and the figures.

DETAILED DESCRIPTION

Figure 1:
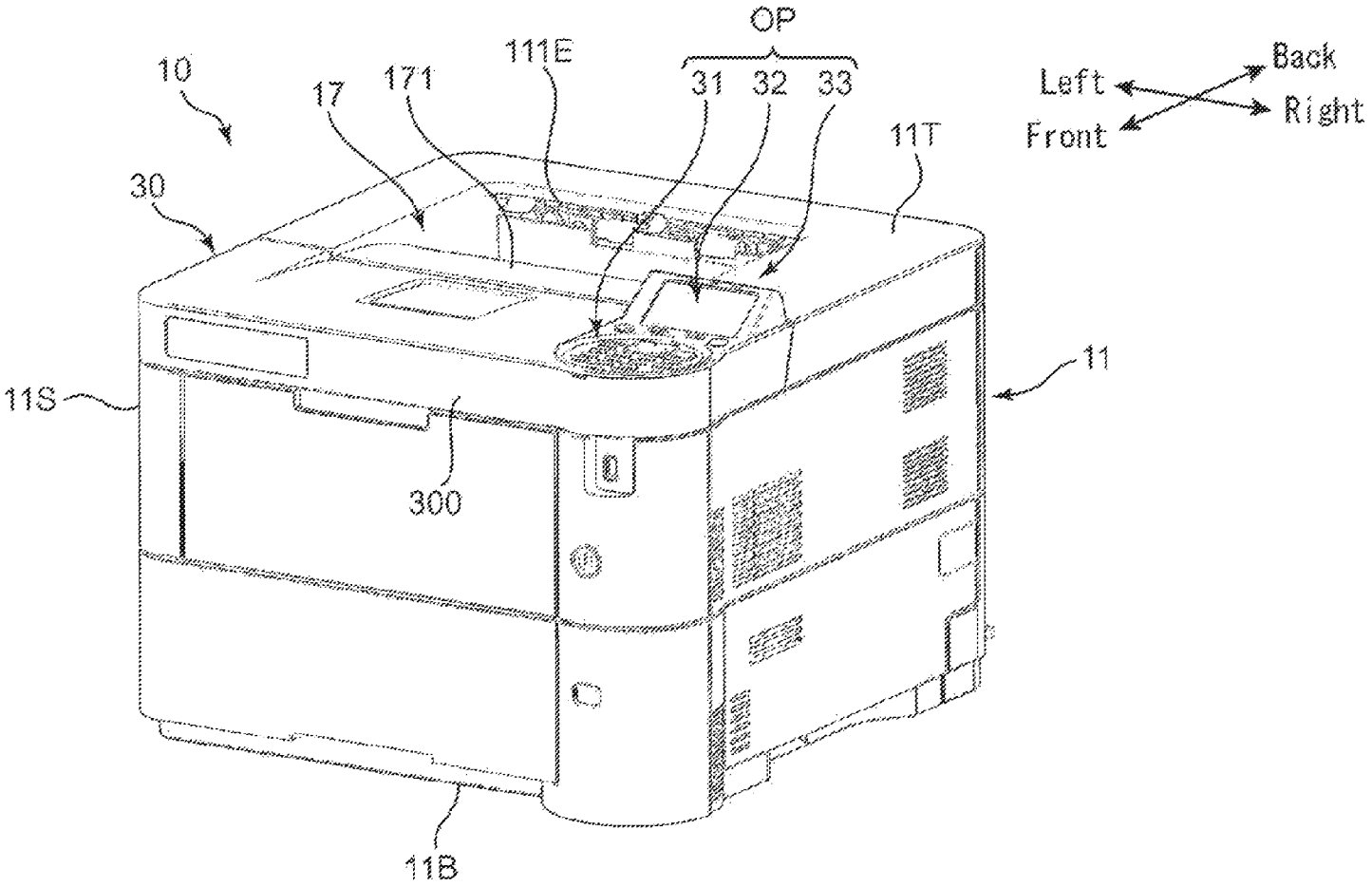
FIG. 1 is an external perspective view of an image forming apparatus according to an embodiment of the present disclosure.

An example of the apparatus is described herein. Other example embodiments or features may further be utilized, and other changes may be made, without departing from the spirit or scope of the subject matter presented herein. In the following detailed description, reference is made to the accompanying drawings, which form a part thereof.

The example embodiments described herein are not meant to be limiting. It will be readily understood that the aspects of the present disclosure, as generally described herein, and illustrated in the drawings, can be arranged, substituted, combined, separated, and designed in a wide variety of different configurations, all of which are explicitly contemplated herein.

An image forming apparatus 10 according to an embodiment of the present disclosure will now be described with reference to the drawings. In this embodiment, a tandem color printer will be described as an example of the image forming apparatus. The image forming apparatus may be, for example, a monochrome printer, a copier, a facsimile, or a multifunction peripheral that combines their capabilities.

FIG. 1 is an external perspective view of the image forming apparatus 10. The image forming apparatus 10 includes a body housing 11 that contains devices, such as an image forming section 13 and other components described below. The body housing 11 is in the shape of a substantially cubic box. The body housing 11 has a bottom surface 11B, four side surfaces 11S that extend vertically from the respective four sides of the bottom surface 11B, and a top surface 11T that covers the top of the space defined by the side surfaces 11S.

The top surface 11T includes a paper ejection unit 17 to which a sheet on which an image has been formed is ejected, an ejection portion 111E from which the sheet is ejected to the paper ejection unit 17, and an operation section OP. The paper ejection unit 17 includes a paper output tray 171 that receives the sheet ejected from the ejection portion 111E. The operation section OP is located at the upper right front of the body housing 11. The operation section OP includes an operation key portion 31, a display panel portion 32, and a state indicator 33.

The operation key portion 31 includes a numeric keypad, a start key, and various operation buttons. The operation key portion 31 accepts an operation instruction for the image forming apparatus 10 from the user. The display panel portion 32 includes a liquid-crystal display panel 42 (see FIG. 5) and displays, for example, printing-related information, operation guidance, and error information.

The status indicator 33 uses an LED lamp unit 43 (see FIG. 6) as a light source. The status indicator 33 lights the LED lamp unit 43 in accordance with predetermined patterns to present various types of state information indicating the status of the image forming apparatus 10. In an embodiment, the status indicator 33 includes three luminous portions (light diffusing portions or end portions 53 illustrated in FIG. 9 etc.). The status indicator 33 turns on, turns off, or intermittently turns on the luminous portions to generate status information. The status information is, for example, information about status of the connection of the image forming apparatus 10 with a local area network, status of the reception of image data from an external device, or the occurrence of trouble in the image forming apparatus 10, such as a sheet jam or running out of toner.

Although the top surface 11T is a flat surface, the paper output tray 171 slopes downwardly toward the ejection portion 111E. The operation section OP partially protrudes upwardly from the top surface 11T. Specifically, a convex portion (protruding housing) having a cross-sectional mountain-like shape in the front-back direction is located at the upper right front of the top surface 11T. The liquid-crystal display panel 42 is located along a forward inclined surface of the convex portion, and the status indicator 33 is located at the top of the convex portion. The front part of the top surface 11T is formed by an operation section unit 30 (operation section cover 300). The operation section unit 30 will be described in detail below.

Figure 2:
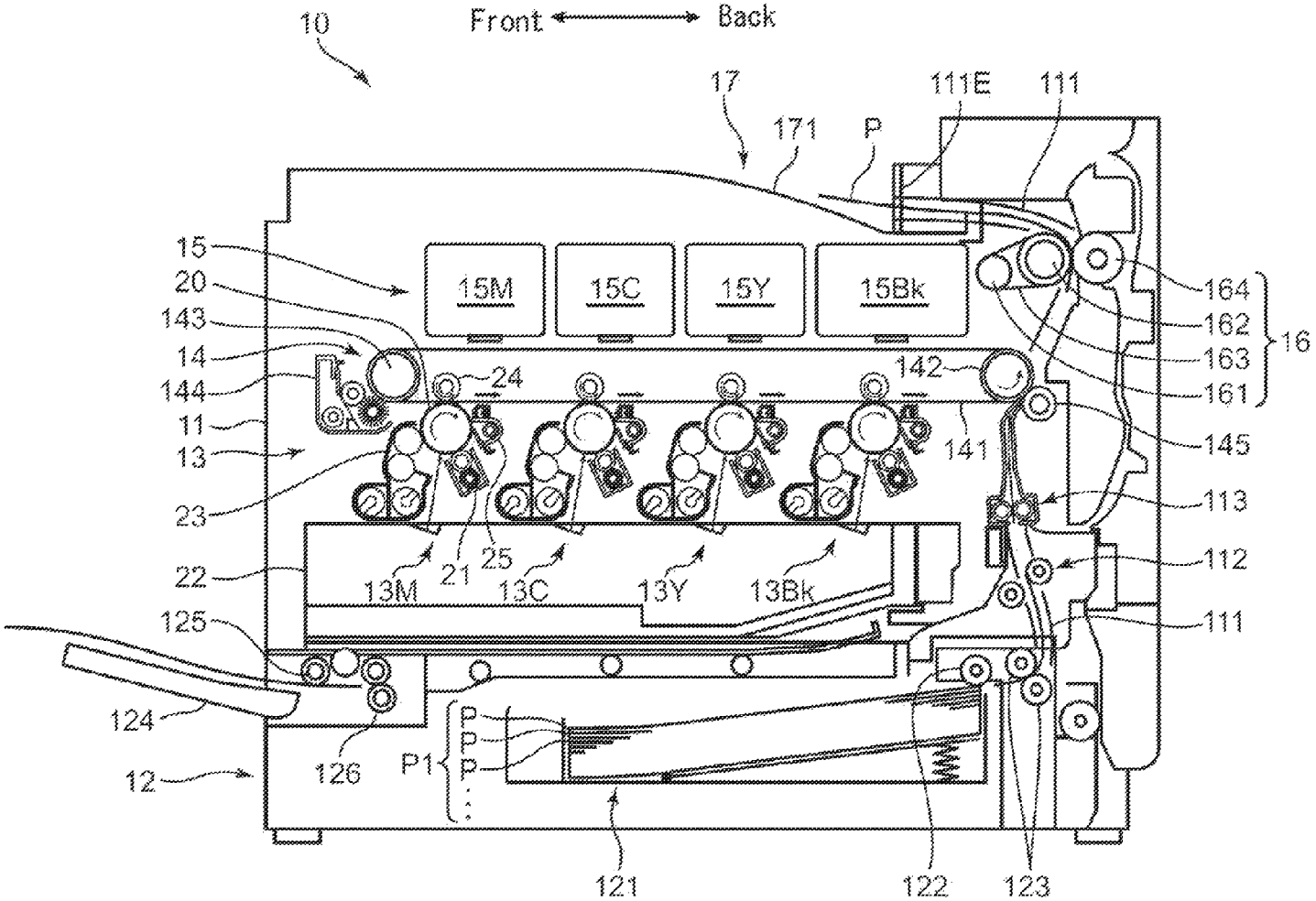
FIG. 2 is a cross-sectional view illustrating an internal structure of the image forming apparatus.

FIG. 2 is a cross-sectional view illustrating an internal structure of the image forming apparatus 10. The body housing 11 includes a paper feed section 12 that feeds a sheet P, the image forming section 13 that forms a toner image to be transferred onto the sheet P fed from the paper feed section 12, an intermediate transfer unit 14 where the toner image is primary-transferred, a toner supply unit 15 that supplies toner to the image forming section 13, and a fixing unit 16 that fixes an unfixed toner image on the sheet P. After being subjected to the fixing operation by the fixing unit 16, the sheet P is ejected to the paper ejection unit 17.

The body housing 11 further includes a sheet conveying path 111 to the right of the image forming section 13. The sheet conveying path 111 extends in the up-down direction. The sheet conveying path 111 is provided with a conveying roller pair 112 that feed a sheet to an appropriate place. The sheet conveying path 111 is also provided with a registration roller pair 113 that not only performs skew correction of the sheet, but also feeds the sheet into a nip portion for secondary transfer (described below) at predetermined timing. The registration roller pair 113 is located upstream of the nip portion in the sheet conveying path 111. The sheet conveying path 111 is a feeding path for feeding the sheet P from the paper feed section 12, through the image forming section 13 and the fixing unit 16, to the paper ejection unit 17 (ejection portion 111E).

The paper feed section 12 includes a paper feed tray 121, a pickup roller 122, and a paper-feed roller pair 123. The paper feed tray 121 is removably mounted in the lower part of the body housing 11. The paper feed tray 121 holds a sheet stack P1 formed by stacking a plurality of sheets P. The pickup roller 122 picks up each sheet P at the top of the sheet stack P1 held in the paper feed tray 121. The paper-feed roller pair 123 feeds the sheet P picked up by the pickup roller 122 to the sheet conveying path 111.

The paper feed section 12 includes a manual paper-feed unit on the front side of the body housing 11. The manual paper-feed unit includes a manual feed tray 124, a pickup roller 125, and a paper-feed roller pair 126. The manual feed tray 124 is a tray on which a sheet P to be manually fed is placed. For manually feeding of the sheet P, the manual feed tray 124 opens from one side of the body housing 11 as illustrated in FIG. 2. The pickup roller 125 picks up the sheet P placed on the manual feed tray 124. The paper-feed roller pair 126 feeds the sheet P picked up by the pickup roller 125 to the sheet conveying path 111.

The image forming section 13 forms a toner image to be transferred to the sheet P. The image forming section 13 includes a plurality of image forming units that form toner images of different colors. In an embodiment, the image forming units are a magenta unit 13M using a magenta (M) developer, a cyan unit 13C using a cyan (C) developer, a yellow unit 13Y using a yellow (Y) developer, and a black unit 13Bk using a black (Bk) developer, which are sequentially arranged from the upstream side to the downstream side (i.e., from the front side to the back side shown in FIG. 2) in the running direction of an intermediate transfer belt 141 (described below). Each of the units 13M, 13C, 13Y, and 13Bk includes a photosensitive drum 20 and a charging device 21, a developing device 23, a primary transfer roller 24, and a cleaning device 25 disposed around the photosensitive drum 20. An exposure device 22 common to the image forming units 13M, 13C, 13Y, and 13Bk is located below the units.

The photosensitive drum 20 rotates about its axis, so that an electrostatic latent image and a toner image are formed on the periphery of the photosensitive drum 20. A photosensitive drum made of amorphous silicon (a-Si)-based material may be used as the photosensitive drum 20. The charging device 21 uniformly charges the surface of the photosensitive drum 20. A contact charging device including a charging roller and a charge cleaning brush for removing toner adhering to the charging roller may be used as the charging device 21. The exposure device 22 includes a light source and various optical units, such as a polygonal mirror, a reflecting mirror, and a deflecting mirror. The exposure device 22 forms an electrostatic latent image by irradiating the uniformly charged periphery of the photosensitive drum 20 with light outputted based on the image data.

The developing device 23 supplies toner to the periphery of the photosensitive drum 20 to develop the electrostatic latent image formed on the photosensitive drum 20. The primary transfer roller 24 and the photosensitive drum 20 form a nip portion, with the intermediate transfer belt 141 of the intermediate transfer unit 14 interposed therebetween. The primary transfer roller 24 primary-transfers the toner image from the photosensitive drum 20 onto the intermediate transfer belt 141. The cleaning device 25 cleans the periphery of the photosensitive drum 20 after the transfer of the toner image.

The intermediate transfer unit 14 is located in a space between the image forming section 13 and the toner supply unit 15. The intermediate transfer unit 14 includes the intermediate transfer belt 141, and a driving roller 142 and a driven roller 143 rotatably supported by a unit frame (not shown). The intermediate transfer belt 141 is an endless belt that runs between the driving roller 142 and the driven roller 143 such that the periphery of the intermediate transfer belt 141 is in contact with the periphery of each of the photosensitive drums 20. The driving roller 142 is given a rotary driving force, and the intermediate transfer belt 141 is driven to run by rotation of the driving roller 142. A belt cleaning device 144, that removes toner remaining on the periphery of the intermediate transfer belt 141, is positioned near the driven roller 143.

A secondary transfer roller 145 is positioned to face the driving roller 142. The secondary transfer roller 145 is pressed against the periphery of the intermediate transfer belt 141 to form a secondary-transfer nip portion. A toner image primary-transferred onto the intermediate transfer belt 141 is secondary-transferred, at the secondary-transfer nip portion, onto a sheet P fed from the paper feed section 12.

The toner supply unit 15 stores toners for use in image formation. In an embodiment, the toner supply unit 15 includes a magenta toner container 15M, a cyan toner container 15C, a yellow toner container 15Y, and a black toner container 15Bk. The toner containers 15M, 15C, 15Y, and 15Bk store toners of MCYBk colors to be supplied. The toner containers 15M, 15C, 15Y, and 15Bk supply the toners of the respective MCYBk colors, through a toner conveying unit (not shown), to the corresponding developing devices 23 of the image forming units 13M, 13C, 13Y, and 13Bk.

The fixing unit 16 includes a heating roller 161 having an internal heat source, a fixing roller 162 positioned to face the heating roller 161, a fixing belt 163 extending between the fixing roller 162 and the heating roller 161, and a pressure roller 164 positioned to face the fixing roller 162 with the fixing belt 163 interposed therebetween. The fixing roller 162 and the pressure roller 164 form a fixing nip portion therebetween. The sheet P fed to the fixing unit 16 is subjected to heat and pressure by passing through the fixing nip portion. Thus, the toner image transferred onto the sheet P at the secondary-transfer nip portion is fixed to the sheet P. After being subjected to the fixing operation, the sheet P is fed through the sheet conveying path 111 running from the upper part of the fixing unit 16, and ejected through the ejection portion 111E toward the paper output tray 171.

Figure 3:
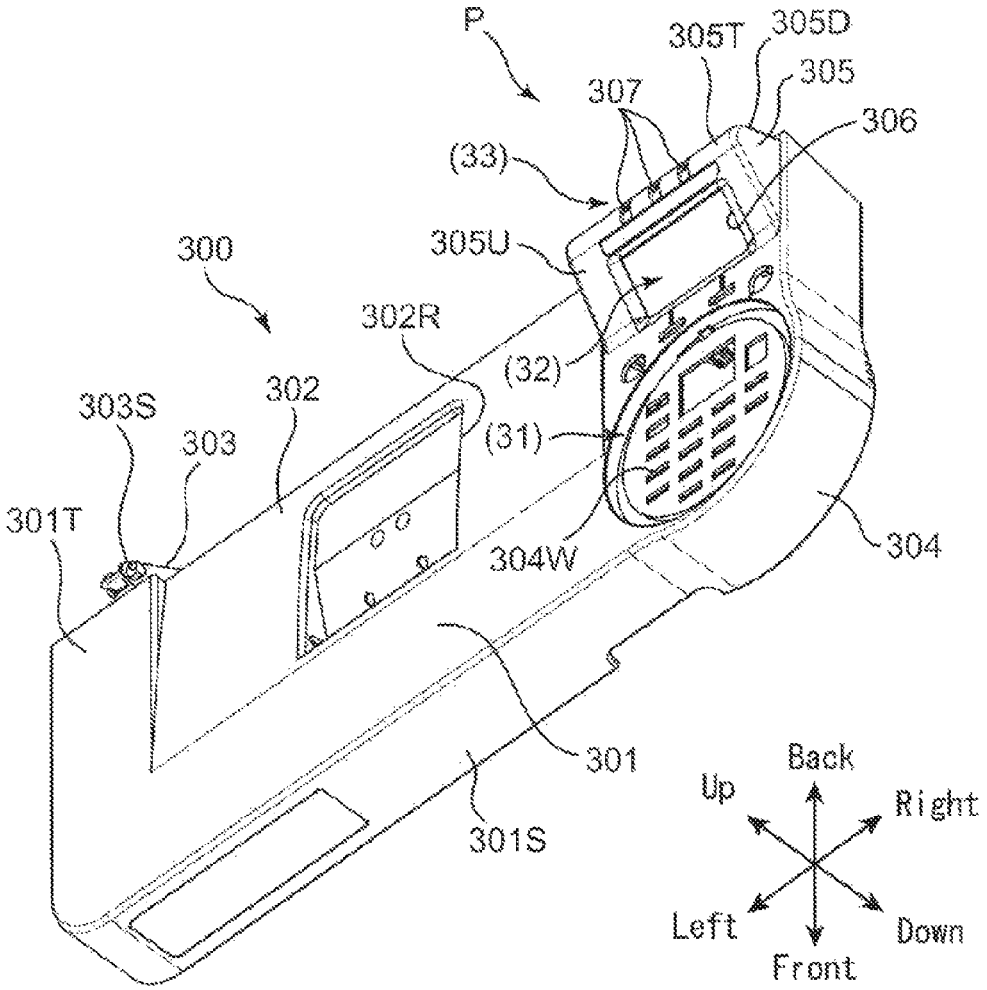
FIG. 3 is a perspective view of an operation section cover.

The operation section unit 30 located in the front part of the top surface 11T of the body housing 11 will now be described. The operation section unit 30 includes the operation section cover 300 that forms part of the top surface 11T. FIG. 3 is a perspective view of the operation section cover 300. The operation section cover 300 is located on the front side of the top surface 11T. The outer surface of the operation section cover 300 forms part of the outer body of the image forming apparatus 10.

The operation section cover 300 includes a top plate 301T, a side plate 301S extended from the front, right, and left edges of the top plate 301T downward, and a rectangular cover body 301 longer in the right-left direction. The cover body 301 includes a paper output recess 302 formed in the central region, an arm 303 jutting out of a left part of the back edge, an operation key housing 304 at the right front, and a protruding housing 305 at the right back.

The paper output recess 302 is a shallow recess that forms a front end portion of the paper ejection unit 17 (paper output tray 171). The paper output recess 302 has a recessed portion 302R in the center in the right-left direction. The user can insert fingers into the recessed portion 302R to remove a sheet. The arm 303 pivotably connects the operation section cover 300 to the body housing 11 (see FIG. 4 and FIG. 5). The arm 303 is provided with a pivot supporting point 303S jutting to the right. The operation section cover 300 pivots, about the pivot supporting point 303S, between open and closed positions relative to the body housing 11. The operation key housing 304 covers the operation key portion 31. The operation key housing 304 includes a plurality of windows 304W that allow various keys to be exposed.

The protruding housing 305 contains the display panel portion 32 and the state indicator 33. The protruding housing 305 is located on the top plate 301T (top surface 11T) and has a top portion 305T protruding upwardly above the top plate 301T. In side view in the right-left direction, the protruding housing 305 has an upward slope 305U rising from the front to the back, the top portion 305T formed by a convex curved surface, and a downward slope 305D falling from the front to the back. The upward slope 305U is provided with a rectangular opening 306 that allows the liquid-crystal display panel 42 (see FIG. 5) to be exposed. The top portion 305T is provided with three grooves (notches) 307 extending in the front-back direction. To circumferentially diffuse light emitted from the end portions 53 of a light guide unit 50 (described below), the grooves 307 are formed by notching parts of the top portion 305T, which is formed by a convex curved surface, to be recessed downwardly (see FIG. 12).

Figure 4:
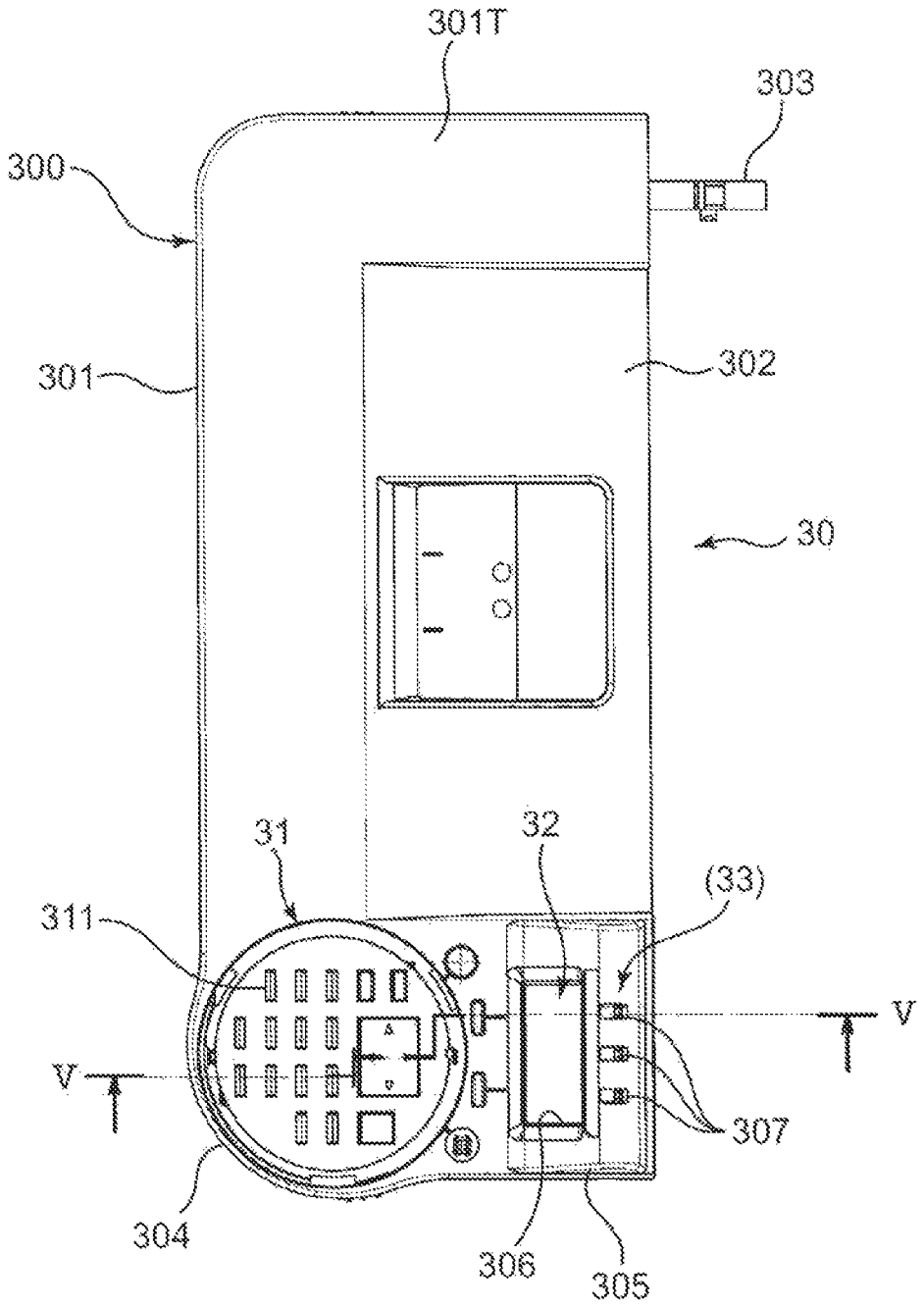
FIG. 4 is a top view of an operation section unit.
Figure 5:
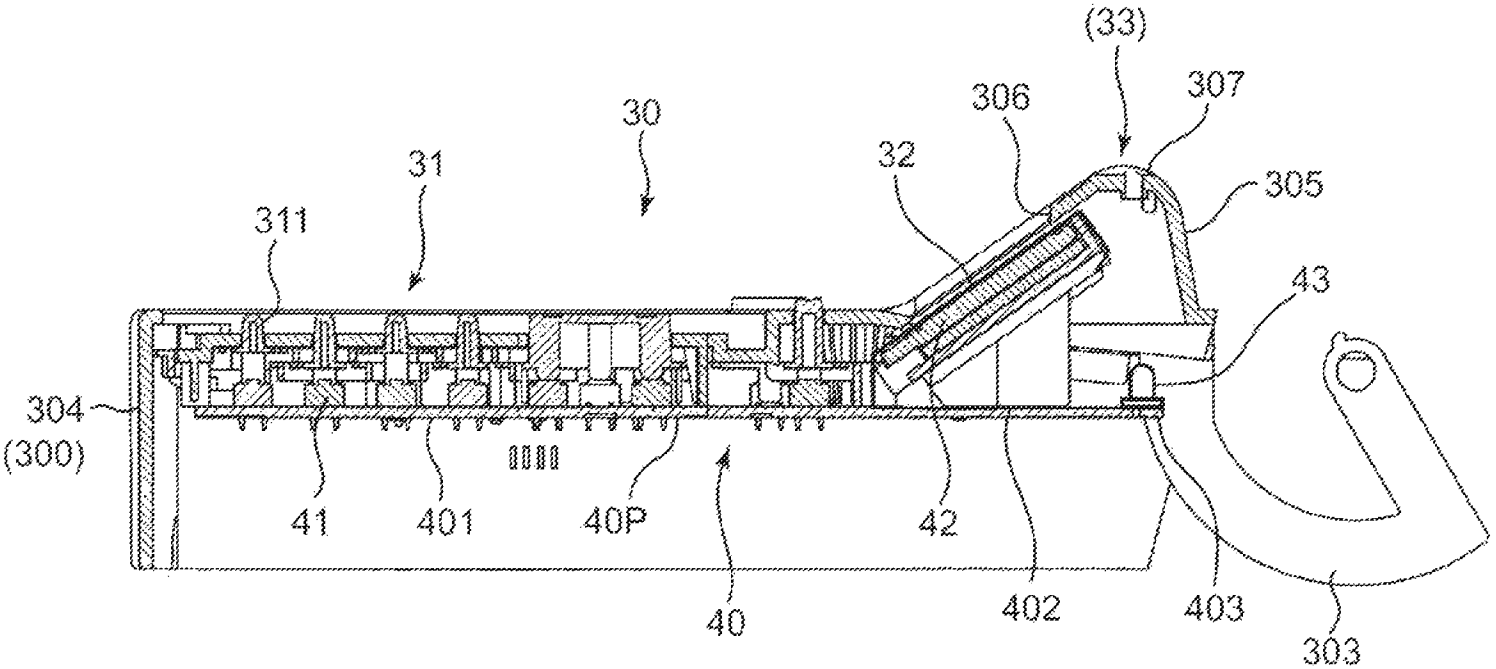
FIG. 5 is a cross-sectional view taken along line V-V of FIG. 4.

FIG. 4 is a top view of the operation section unit 30, and FIG. 5 is a cross-sectional view taken along line V-V of FIG. 4. The operation section unit 30 includes the operation section cover 300 and an operation-section substrate unit 40 assembled to the operation section cover 300. The operation-section substrate unit 40 includes a printed circuit board 40P, key switches 41 mounted on the printed circuit board 40P, the liquid-crystal display panel 42, and the LED lamp unit 43 (light source).

Figure 6:
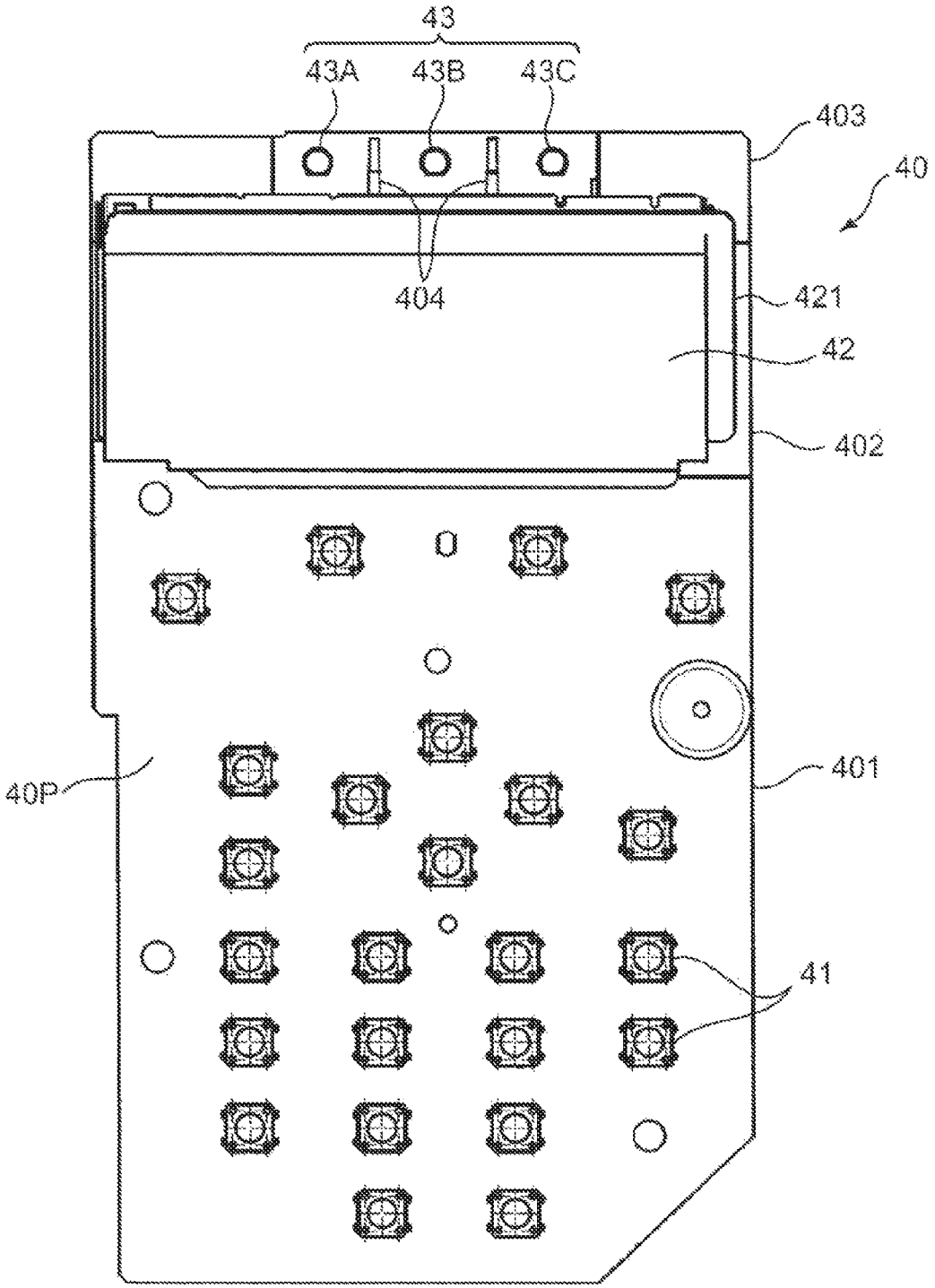
FIG. 6 is a top view of an operation-section substrate unit.
Figure 7A:
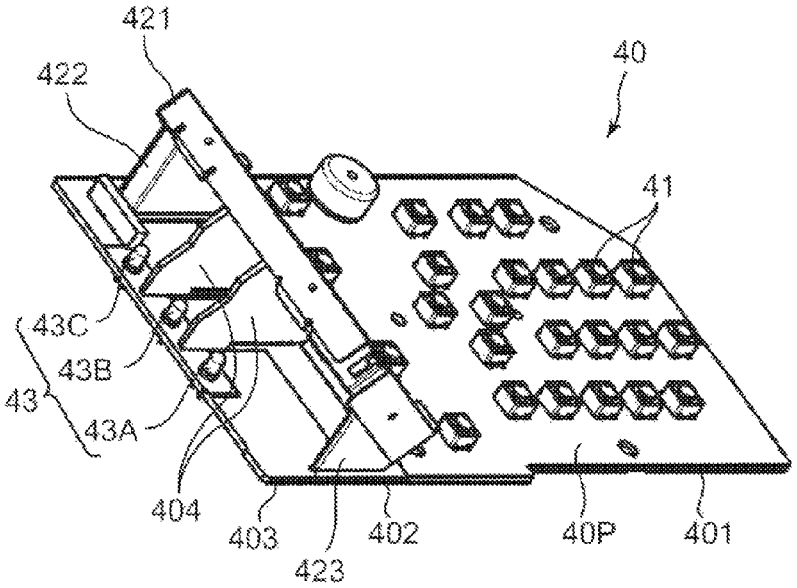
FIG. 7A and FIG. 7B are perspective views of the operation-section substrate unit.
Figure 7B:
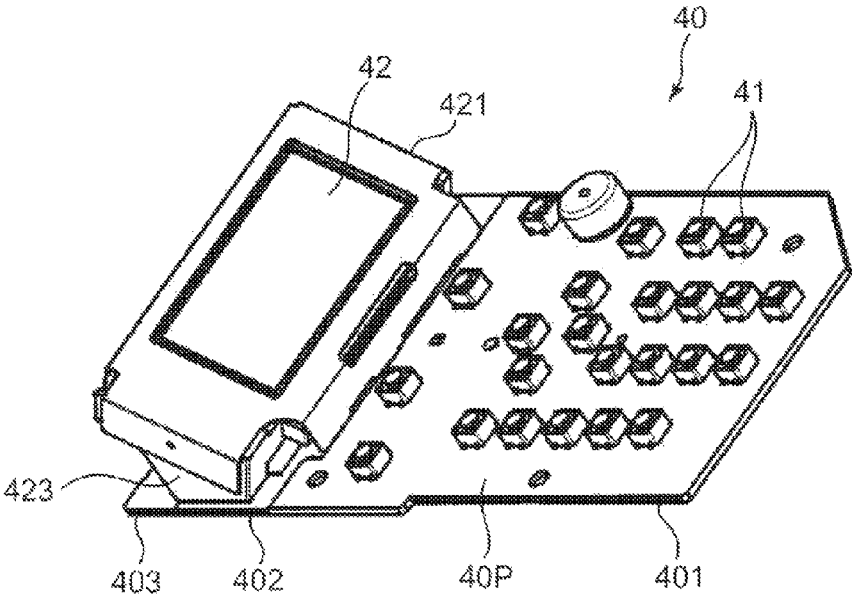

FIG. 6 is a top view of the operation-section substrate unit 40, and FIG. 7A and FIG. 7B are perspective views of the operation-section substrate unit 40. FIG. 7B is an inverted perspective view of FIG. 7A.

The printed circuit board 40P has a switch pattern portion 401 having a predetermined circuit pattern and extending from the front to the center thereof, a panel supporting portion 402 adjacent to the switch pattern portion 401, and a back portion 403 having the LED lamp unit 43 mounted thereon.

The key switches 41 correspond to respective key buttons 311 (see FIG. 4 and FIG. 5) actually touched by the user. The key switches 41 are mounted on the switch pattern portion 401 of the printed circuit board 40P. When one of the key buttons 311 is pressed down, the corresponding key switch 41 is activated and a switch pattern immediately below the key switch 41 conducts, so that a key controller (not shown) acquires a press-down signal. The key buttons 311 serve as keys of the numeric keypad and the start key described above.

The liquid-crystal display panel 42 is rectangular in shape and is assembled to a frame 421 having an opening that allows the display panel portion 32 to be exposed. The frame 421 is supported by supporting plates 422 and 423 vertically extending at both ends of the panel supporting portion 402 of the printed circuit board 40P. The frame 421 is supported at an angle of inclination of the upward slope 305U of the protruding housing 305.

The LED lamp unit 43 is a luminous member formed by molding a LED chip with transparent resin. The LED lamp unit 43 is mounted on the back portion 403 of the printed circuit board 40P. In an embodiment, first, second, and third LED lamps 43A, 43B, and 43C are provided as light sources. However, it is only necessary that at least one LED lamp be provided. For providing more information based on the illumination state of the lamp, it is preferable to provide more than one LED lamp.

The first and second LED lamps 43A and 43B each contain a green LED chip, whereas the third LED lamp 43C contains a yellow LED chip. Partition plates 404 are provided between the first and second LED lamps 43A and 43B and between the second and third LED lamps 43B and 43C to prevent leakage of light. The partition plates 404 also serve to support the back surface of the center portion of the frame 421 that holds the liquid-crystal display panel 42.

In an embodiment, light emitted from the LED lamp unit 43 is diffused outward from the top portion 305T of the protruding housing 305, which is at the highest position in the image forming apparatus 10. A light guide path (light guide unit 50) is used to guide the light from the top surface (light emitting portion) of the LED lamp unit 43 to the top portion 305T (see FIG. 9). A configuration related to the light guide unit 50 will now be described in detail.

Figure 8:
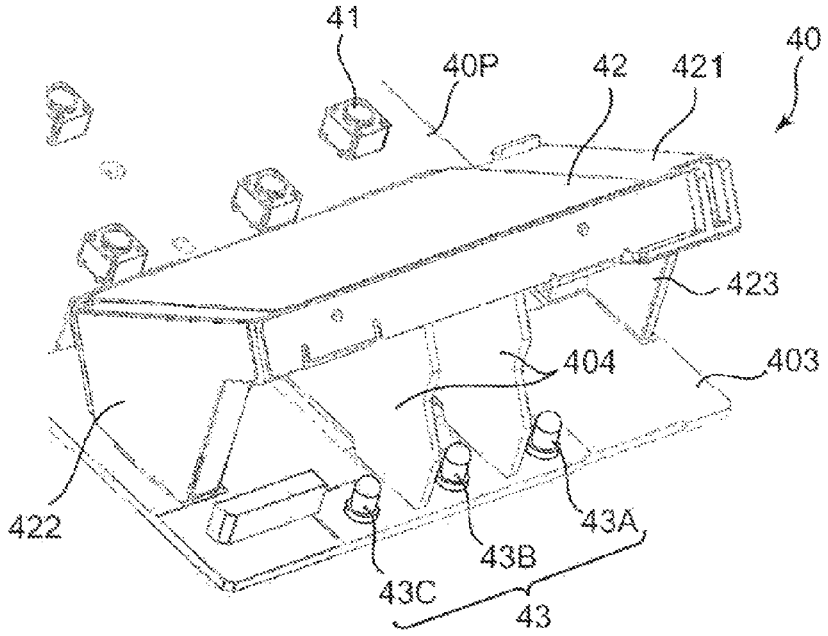
FIG. 8 is an enlarged perspective view of a major part of the operation-section substrate unit.
Figure 9:
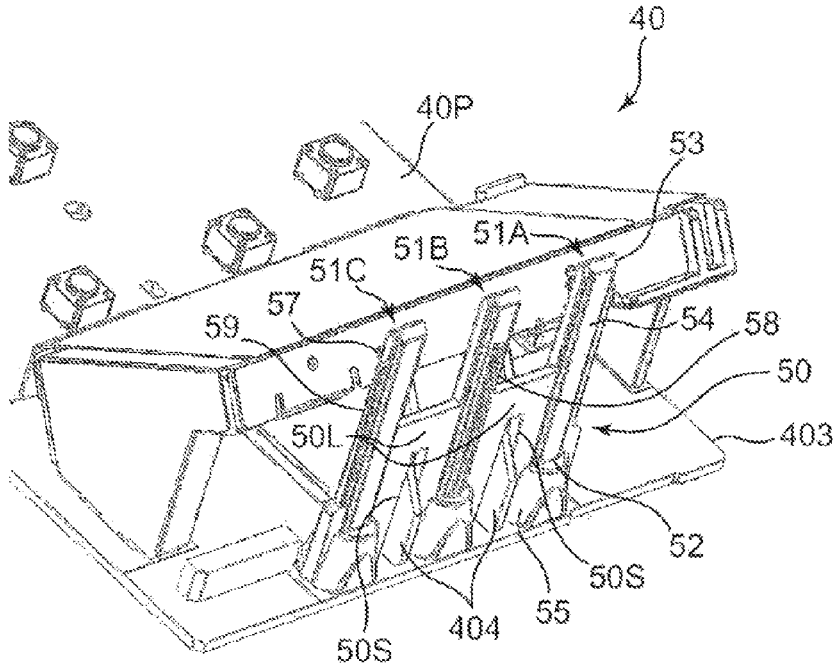
FIG. 9 is a perspective view of the operation-section substrate unit illustrated in FIG. 8 and a light guide unit attached thereto.
Figure 10A:
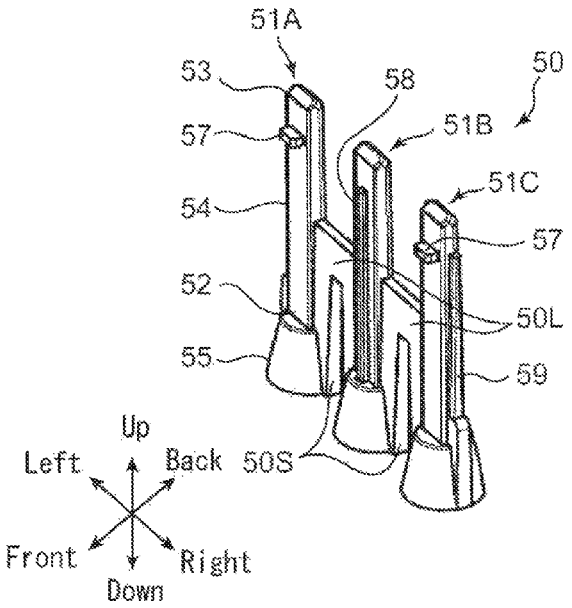
FIG. 10A to FIG. 10D are perspective views of the light guide unit.
Figure 10B:
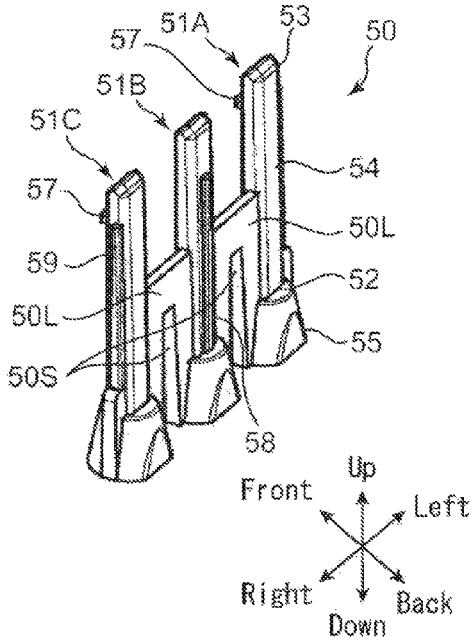
Figure 10C:
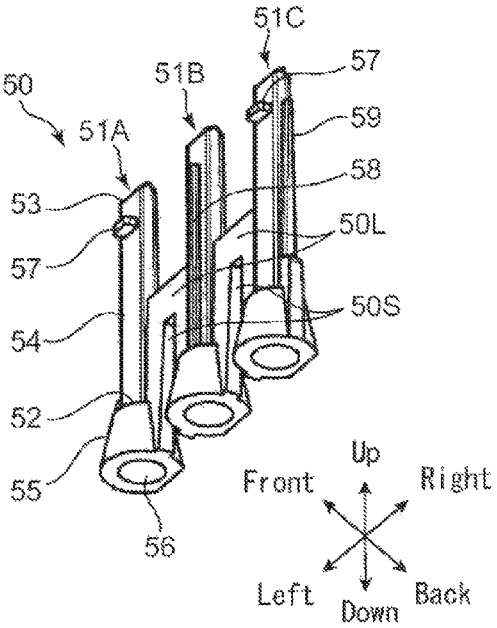
Figure 10D:
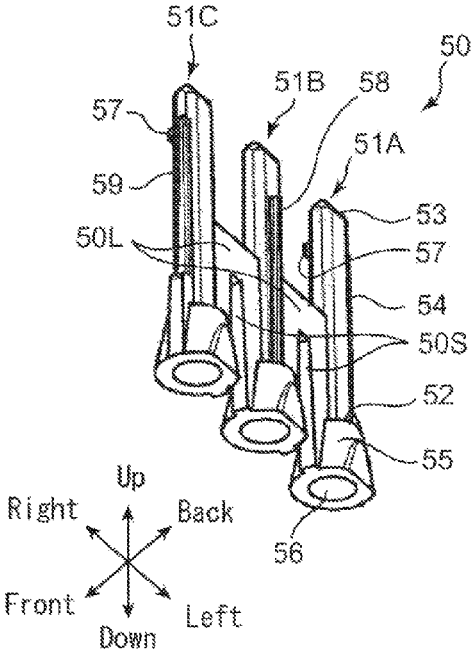

FIG. 8 is an enlarged perspective view of a major part of the operation-section substrate unit 40, FIG. 9 is a perspective view of the operation-section substrate unit 40 illustrated in FIG. 8 and the light guide unit 50 attached thereto, and FIG. 10A to FIG. 10D are perspective views of the light guide unit 50. FIG. 10A to FIG. 10D illustrate the light guide unit 50 as viewed from different directions. The light guide unit 50 includes first, second, and third unit light guides 51A, 51B, and 51C arranged side by side, and connecting ribs 50L (joint members) that connect them to form a single unit. The first, second, and third unit light guides 51A, 51B, and 51C correspond to the first, second, and third LED lamps 43A, 43B, and 43C, respectively. The unit light guides 51A, 51B, and 51C serve as light guide paths that guide light emitted from the LED lamps 43A, 43B, and 43C to the top portion 305T.

Since the three unit light guides 51A, 51B, and 51C have the same structure, the structure of only the first unit light guide 51A (light guide) will be described. The first unit light guide 51A is a rod-like member made of transparent resin material and extending in an up-down direction. The first unit light guide 51A has a base portion 52, the end portion 53, a body portion 54, and a supporting member 55. The base portion 52 is located at a lower end of a rod-like portion of the first unit light guide 51A. Light emitted from the first LED lamp 43A travels into the base portion 52. The end portion 53 (light diffusing portion) is located at an upper end of the rod-like portion of the first unit light guide 51A. The light is diffused outward from the end portion 53. The body portion 54 (light guide path) forms a main body of the rod-like portion of the first unit light guide 51A, and connects the base portion 52 to the end portion 53. The supporting member 55 is connected to the lower end of the base portion 52.

The body portion 54 has a substantially rectangular horizontal cross-section. In contrast, the supporting member 55 is a cylindrical body internally provided with a cavity 56 and having a diameter decreasing toward an upward position (see FIG. 13 and FIG. 14). The upper end of the supporting member 55 is integrally connected to the base portion 52 to hold the base portion 52. The supporting member 55 is open at the lower end to allow the cavity 56 to be exposed. The cavity 56 has an inner diameter and a height that accommodates the first LED lamp 43A.

The first and third unit light guides 51A and 51C each are provided with a retaining portion 57 jutting out of the front surface of the body portion 54 at a position near the upper end of the body portion 54. The retaining portion 57 is a protrusion for positioning the light guide unit 50 in the up-down direction. The second unit light guide 51B is provided with ridges 58 jutting from the front and back surfaces of the body portion 54 and extending in the up-down direction. The ridges 58 are protrusions for positioning the light guide unit 50 in the right-left direction. The third unit light guide 51C is provided with ridges 59 jutting from the right side surface of the body portion 54 and extending in the up-down direction. The ridges 59 are protrusions for positioning the light guide unit 50 in the front-back direction.

In substantially the center of the body portions 54 in the up-down direction, one of the connecting ribs 50L connects the first and second unit light guides 51A and 51B to each other, and the other of the connecting ribs 50L connects the second and third unit light guides 51B and 51C to each other. The connecting ribs 50L are each a plate-like member having a slit 50S extending in the up-down direction.

As illustrated in FIG. 9, the light guide unit 50 is located on the back portion 403 of the printed circuit board 40P such that the lower ends of the supporting members 55 are in contact with the mounting surface of the printed circuit board 40P. The first, second, and third LED lamps 43A, 43B, and 43C are contained in the respective cavities 56 of the light guide unit 50. The partition plates 404 are positioned in the respective slits 50S of the connecting ribs 50L. With this configuration, the light guide unit 50 can be supported by using the mounting surface of the printed circuit board 40P. At the same time, the light guide unit 50 can be positioned by using the partition plates 404 and the first, second, and third LED lamps 43A, 43B, and 43C mounted on the printed circuit board 40P. It is thus possible to improve work efficiency during manufacture and maintenance of the image forming apparatus 10.

Figure 11:
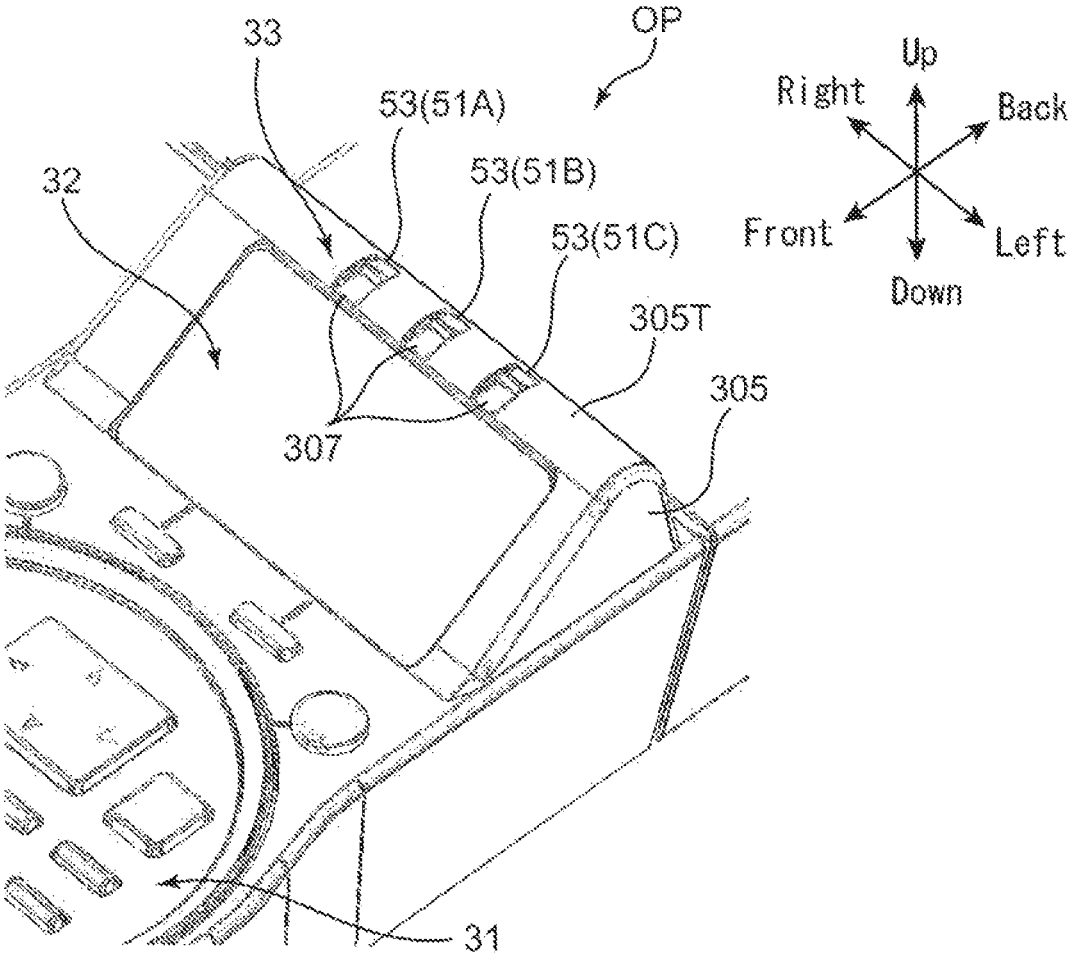
FIG. 11 is an enlarged perspective view of an operation section.
Figure 12:
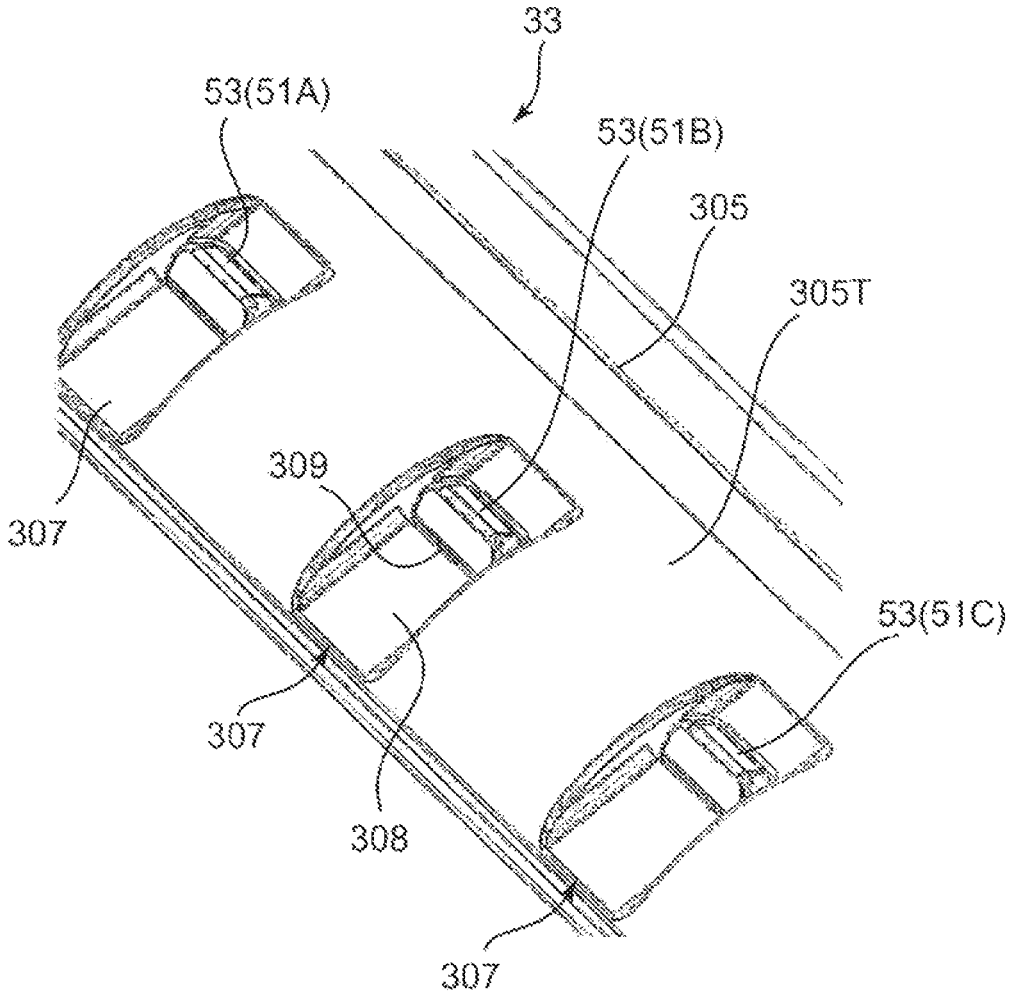
FIG. 12 is an enlarged perspective view of a status indicator.
Figure 13:
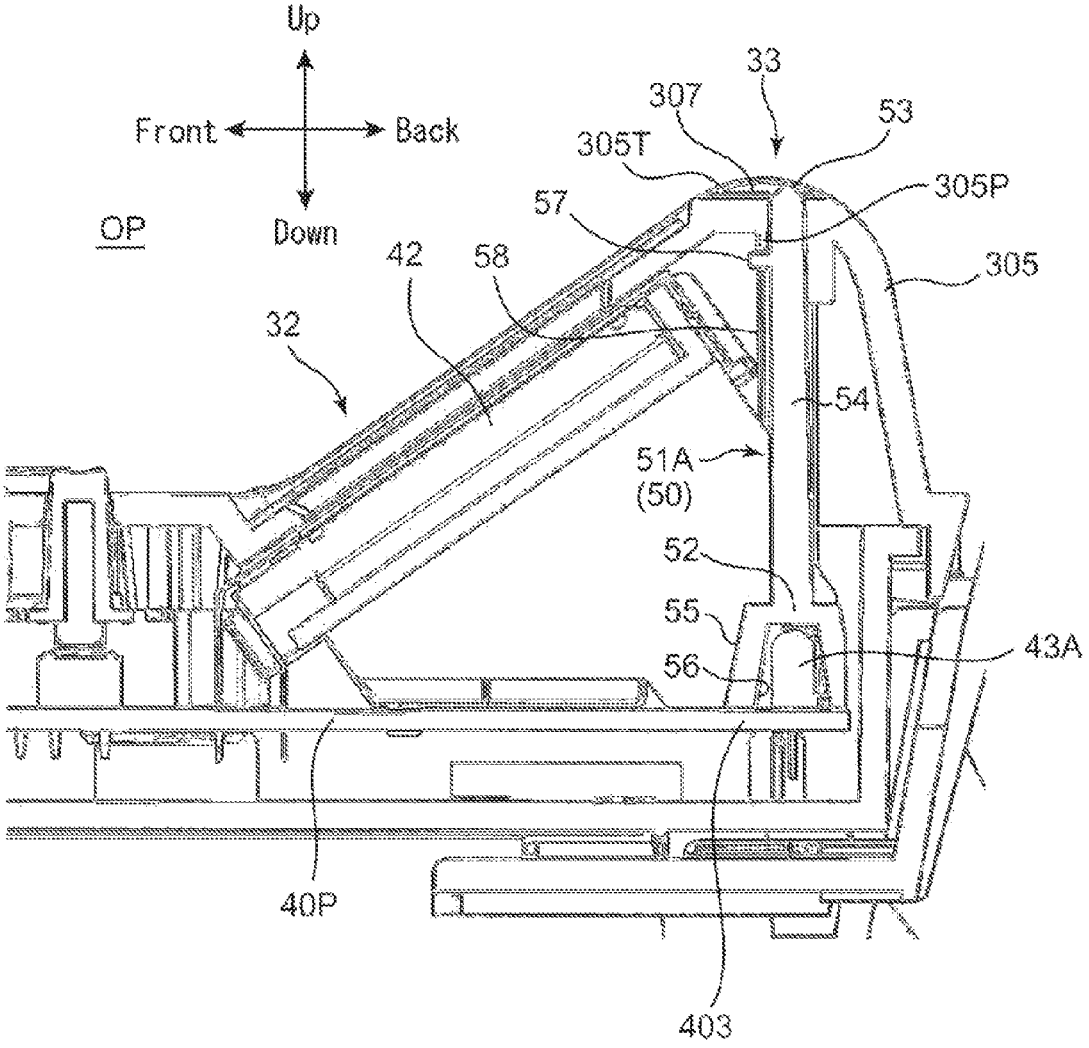
FIG. 13 is a cross-sectional view of the operation section.
Figure 14:
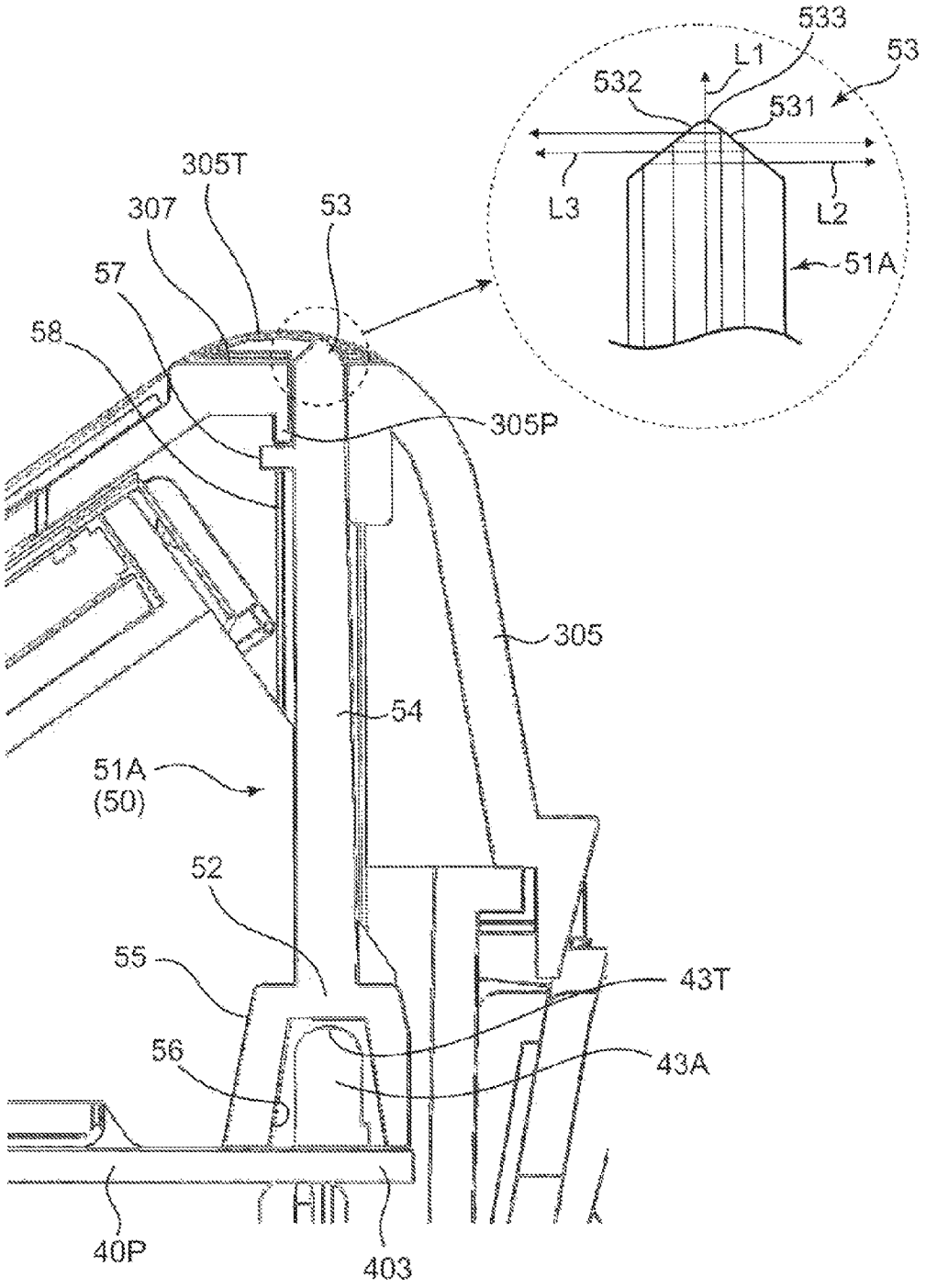
FIG. 14 is an enlarged cross-sectional view of the status indicator, and provides a further enlarged cross-sectional view of an end portion of a light guide in a dotted circle.

FIG. 11 is an enlarged perspective view of the operation section OP. FIG. 12 is an enlarged perspective view of the status indicator 33. FIG. 13 is a cross-sectional view of the operation section OP. FIG. 14 is an enlarged cross-sectional view of the status indicator 33 and its vicinity, and provides a further enlarged cross-sectional view of the end portion 53 of the first unit light guide 51A in a dotted circle. As described above, the top portion 305T of the protruding housing 305 is provided with the three grooves 307 formed by recessing parts of the top portion 305T. Each of the grooves 307 has a bottom portion 308 and an opening 309 formed in the bottom portion 308.

The printed circuit board 40P is covered by the protruding housing 305, with the mounting surface having the first, second, and third LED lamps 43A, 43B, and 43C thereon facing upward. The three openings 309 of the grooves 307 are located directly above the respective mounting positions of the LED lamps 43A, 43B, and 43C on the printed circuit board 40P. The end portions 53 of the first, second, and third unit light guides 51A, 51B, and 51C fitted onto the LED lamps 43A, 43B, and 43C are exposed outwardly through the openings 309, whereas the body portions 54 and other lower parts are covered by the protruding housing 305. The end portions 53 protrude above the bottom portions 308, but are contained in the grooves 307. With this configuration, where the end portions 53 (light diffusing portions) are positioned inside the grooves 307, the end portions 53 can be protected from external force. Additionally, since light emitted from the end portions 53 can be diffused through the openings 309 of the grooves 307, it is possible to improve visibility of the illumination information.

Referring to FIG. 14, the end portion 53 of the first unit light guide 51A has first and second cut surfaces 531 and 532 for refracting light and diffusing the light outwardly. The cut surfaces 531 and 532 are inclined surfaces formed by cutting the upper end of the body portion at an angle. With the cut surfaces 531 and 532, the end portion 53 has a mountain-like cross-sectional shape with a peak 533 in the front-back direction. The base portion 52 and a top portion 43T of the mold of the LED lamp unit 43 face each other, with a small gap therebetween. The supporting member 55 is connected to the outer surface of the base portion 52, and the periphery of the first LED lamp 43A is surrounded by the cylindrical wall of the supporting member 55. The same applies to the second and third unit light guides 51B and 51C.

Light emitted from the first LED lamp 43A travels from the base portion 52 into the first unit light guide 51A. The incident light propagates through the body portion 54 to reach the end portion 53. Then, the light is diffused outward from the end portion 53. The diffused light includes light L1 that has passed through the peak 533 and its vicinity and emitted upward, light L2 that has been refracted (or reflected) by the second cut surface 532 and emitted from the first cut surface 531, and light L3 that has been refracted (or reflected) by the first cut surface 531 and emitted from the second cut surface 532. Obviously, the diffused light includes light that has been refracted by the first cut surface 531 and emitted from the first cut surface 531, and light that has been refracted by the second cut surface 532 and emitted from the second cut surface 532.

As described above, light that has reached the end portion 53 is not only emitted from the peak 533 and its vicinity, but is also diffused circumferentially by being refracted by the first and second cut surfaces 531 and 532. In the present specification, reflection is described as a mode of refraction. Since the first and second cut surfaces 531 and 532 face the flat bottom portion 308 of each of the grooves 307, it is possible to provide a wide angle of view from the direction facing the cut surfaces 531 and 532. Additionally, since the end portions 53, which serve as light diffusing portions, are located near the top portion 305T of the protruding housing 305, the illumination of the end portions 53 can be easily viewed by the user from any direction relative to the image forming apparatus 10.

As illustrated in FIG. 13 and FIG. 14, the retaining portion 57 of the first unit light guide 51A (or third unit light guide 51C) is pressed by a pressing portion 305P inside the protruding housing 305, with the light guide unit 50 internally assembled to the protruding housing 305. Thus, the up-down movement of the light guide unit 50 is regulated by the pressing portion 305P and the back portion 403 of the printed circuit board 40P. Although not shown in the drawings, the protruding housing 305 is internally provided with engaging portions that engage with the ridges 58 on the second unit light guide 51B and the ridges 59 on the third unit light guide 51C. This regulates the movement of the light guide unit 50 in the right-left direction and the front-back direction.

As described above, in an embodiment, light emitted from the first, second, and third LED lamps 43A, 43B, and 43C passes through the body portions 54 of the unit light guides 51A, 51B, and 51C of the light guide unit 50 and is guided to the end portions 53 serving as light diffusing portions. The light guide unit 50 is mostly contained inside the protruding housing 305. However, since the end portions 53 are exposed outwardly through the openings 309 in the top portion 305T of the protruding housing 305, light can be diffused outwardly from the end portions 53. Since the top portion 305T protrudes upwardly above the top surface 11T of the body housing 11, light emitted from the end portions 53 can be easily viewed from any direction relative to the image forming apparatus 10.

Through the use of the light guide unit 50, the number of substrates to be used can be reduced. Specifically, if the LED lamp unit 43 is located at the top portion 305T of the protruding housing 305, a substrate for mounting the LED lamp unit 43 needs to be placed immediately below the top portion 305T. Since it is difficult to secure a space near the top portion 305T, the substrate has to be a dedicated substrate specifically designed for mounting the LED lamp unit 43. This results in an increase in the number of substrates. However, in an embodiment, where light is guided by the light guide unit 50 to the top portion 305T, the LED lamp unit 43 can be mounted on the printed circuit board 40P where other electronic devices (e.g., the key switches 41 and the liquid-crystal display panel 42) are mounted. This means that the LED lamp unit 43 does not require a dedicated substrate. Since the unit light guides 51A, 51B, and 51C can be formed by simple linear rod-like members, it is possible to simplify the structure.

Figure 15:
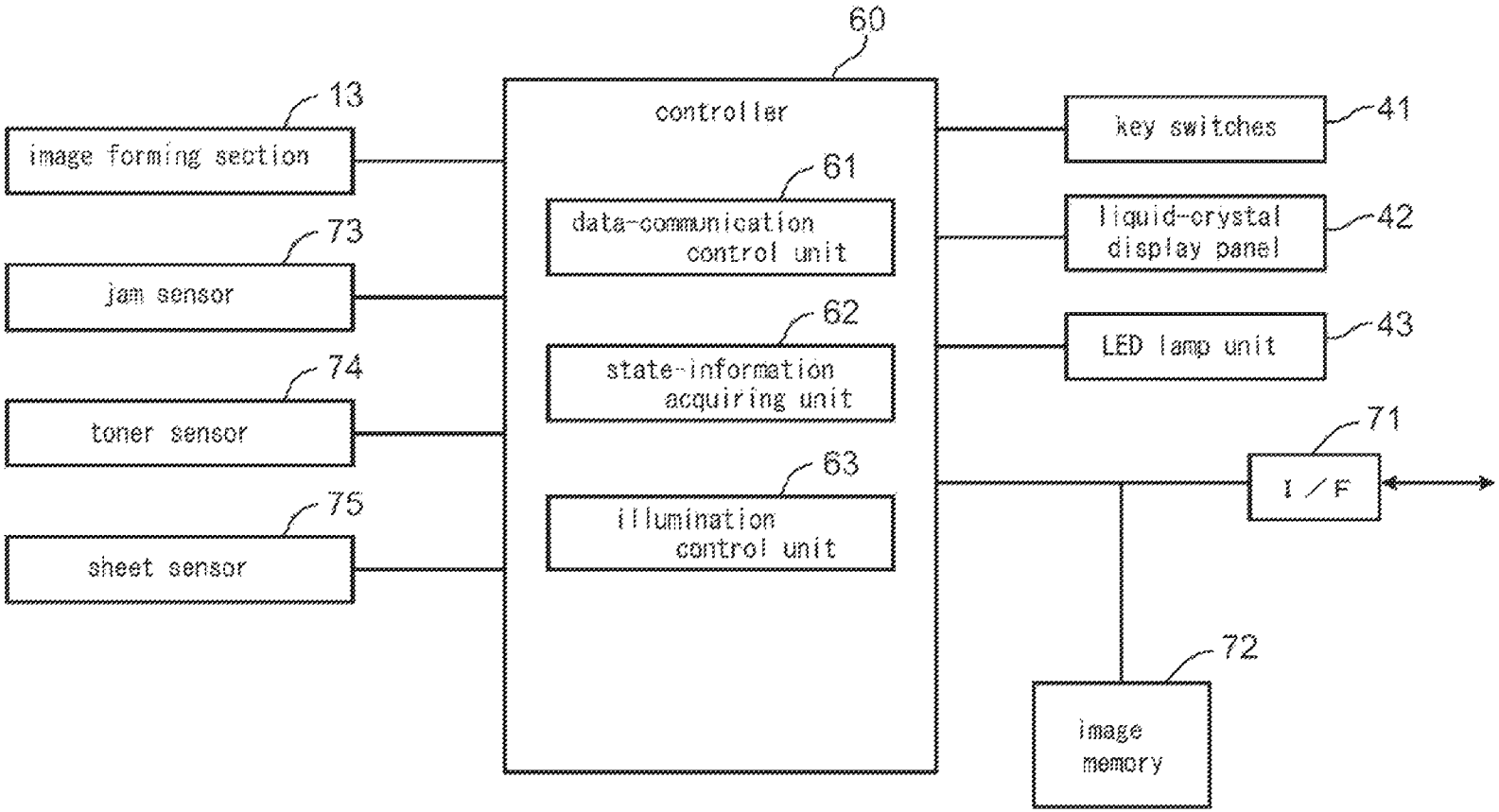
FIG. 15 is a block diagram illustrating an electrical configuration of the image forming apparatus.

An electrical configuration of the image forming apparatus 10 will now be described. FIG. 15 is a block diagram illustrating an electrical configuration of the image forming apparatus 10. The image forming apparatus 10 includes a controller 60 that controls the overall operation of the image forming section 13 and other components of the image forming apparatus 10. The controller 60 includes a central processing unit (CPU), a read only memory (ROM) that stores control programs, and a random access memory (RAM) that is used as a work area for the CPU. In addition to the components described with reference to FIG. 1 to FIG. 14, the image forming apparatus 10 includes an interface (I/F) 71, an image memory 72, a jam sensor 73, a toner sensor 74, and a sheet sensor 75.

The I/F 71 is an interface circuit for realizing data communication with an external device. For example, the I/F 71 not only generates a communication signal in accordance with a network communication protocol for connecting the image forming apparatus 10 to the external device, but also converts a communication signal from the network into data having a format that can be processed by the image forming apparatus 10. A print instruction signal transmitted from a personal computer or the like is given through the I/F 71 to the controller 60, whereas image data is transmitted through the I/F 71 and stored in the image memory 72. The image memory 72 temporarily stores print image data given from an external device, such as a personal computer.

The jam sensor 73 is formed, for example, by a photo-interrupter. The jam sensor 73 is placed at an appropriate position in the sheet conveying path 111 and detects a jam of a sheet fed along the sheet conveying path 111. The toner sensor 74 is formed, for example, by a magnetic sensor mounted on the wall surface of each of the toner containers 15M, 15C, 15Y, and 15Bk. The toner sensor 74 outputs an electric signal based on the amount of toner remaining in the container. The sheet sensor 75 is formed, for example, by a light reflective sensor positioned to face the paper feed tray 121. The sheet sensor 75 outputs an electric signal based on the presence or absence of a sheet in the paper feed tray 121.

In the controller 60, the CPU executes a control program stored in the ROM to control the operation of each component of the image forming apparatus 10 for image formation. In an embodiment, for controlling illumination of the LED lamp unit 43, the controller 60 further includes a data-communication control unit 61, a status-information acquiring unit 62, and an illumination control unit 63.

The data-communication control unit 61 controls the connection with an external device or network through the I/F 71, and controls data communication with the external device through the I/F 71.

The status-information acquiring unit 62 receives an electric signal outputted from the jam sensor 73, the toner sensor 74, or the sheet sensor 75 to detect whether there is a sheet jam, toner has run out, or sheets have run out. That is, the status-information acquiring unit 62 acquires status information of the image forming apparatus 10 based on the information related to image formation received from various sensors.

The illumination control unit 63 controls the illumination of the LED lamp unit 43 (first, second, and third LED lamps 43A, 43B, and 43C). For controlling the illumination, the illumination control unit 63 refers to a data-communication control status of the data-communication control unit 61, and status information acquired by the status-information acquiring unit 62. For example, the first LED lamp 43A is controlled to blink at predetermined intervals while image data is being received from an external device through the I/F 71. The second LED lamp 43B is controlled to illuminate when the image forming apparatus 10 is connected to a predetermined network (i.e., when the image forming apparatus 10 is online). The third LED lamp 43C is controlled to illuminate when the status-information acquiring unit 62 detects the occurrence of trouble in the apparatus, such as a sheet jam, toner has run out, or sheets have run out.

The user views the illumination status of the first, second, and third LED lamps 43A, 43B, and 43C of the status indicator 33 to recognize the status information of the image forming apparatus 10. As described above, light emitted from the LED lamps 43A, 43B, and 43C is passed through the light guide unit 50 and diffused from the top portion 305T of the protruding housing 305 higher than the top surface 11T of the body housing 11. Therefore, the user can easily view the status indicator 33 from any direction. The user can thus reliably recognize the status information indicated by the illumination of the LED lamps 43A, 43B, and 43C.

Although an embodiment of the present invention has been described in detail, the present invention is not limited to this. For example, the embodiment of the present invention may be modified as described below.

(1) In the embodiment described above, the light guide unit 50 (body portion 54) has been described as a light guide path. Alternatively, the light guide path may be a flexible light guide, such as an optical fiber. In this embodiment, an optical component having cut surfaces similar to those of the end portion 53 is provided, as a light diffusing portion, near the top portion 305T of the protruding housing 305. Then, the optical fiber is positioned to face an LED lamp at one end, and to face the lower surface of the optical component at the other end.

(2) Alternatively, the light guide path may be formed by a light guide space without specifically using a solid component. In this embodiment, a tubular member is used to define the light guide space, and a light reflective coating is applied to the inner wall of the tubular member. An opening at the lower end of the light guide space is positioned to face an LED lamp, and an opening at the upper end of the light guide space is positioned to face the lower surface of the optical component serving as a light diffusing portion.

(3) In the embodiment described above, the grooves 307 extending in the front-back direction have been described as notches at the top portion 305T of the protruding housing 305. Alternatively, the notches may be bowl-shaped notches, each having an opening at the bottom which allows protrusion of the corresponding end portion 53 of the light guide unit 50. In this embodiment, the end portion 53 preferably has a quadrangular pyramid shape or a dome shape so that light can be substantially uniformly diffused in the circumferential direction.

(4) In the embodiment described above, the end portions 53 serving as light diffusing portions are located in the top portion 305T of the protruding housing 305. As long as the visibility of the image forming apparatus 10 from its surroundings is ensured, the light diffusing portions may be located near the top portion 305T, not in the top portion 305T. In the embodiment above, the top portion 305T formed by a convex curved surface has been described as an example. However, the top portion of the protruding housing may be a flat surface. In other words, for example, the protruding housing may be in the shape of a trapezoid or a rectangular parallelepiped.

(5) In the embodiment above, the LED lamp unit 43 has been described as a light source. However, the light source is not particularly limited, and may be an incandescent lamp, an electroluminescent (EL) lamp, or other known small light sources.

The present disclosure is not to be limited in terms of the particular embodiments described in this application, which are intended as illustrations of various aspects. Many modifications and variations can be made without departing from its spirit and scope, as will be apparent to those skilled in the art. Functionally equivalent apparatuses within the scope of the disclosure, in addition to those enumerated herein, will be apparent to those skilled in the art from the foregoing descriptions. Such modifications and variations are intended to fall within the scope of the appended claims.

The invention is claimed as follows:

1. An image forming apparatus comprising:

an image forming section configured to perform image formation on a sheet;

a body housing formed by a box body with a top surface, a back side surface and a front side surface and configured to contain the image forming section;

a protruding housing located on the top surface and having a top portion protruding upwardly above the top surface;

a light diffusing portion disposed in the protruding housing;

a light source located inside the body housing or the protruding housing and configured to emit light;

a light guide configured to guide light emitted by the light source to the light diffusing portion; and a control unit configured to control illumination of the light source depending on a state of the image forming apparatus, wherein the light diffusing portion is formed by a transparent member having a light diffusing surface for diffusing the light outwardly, the protruding housing includes an upward slope raising to the top portion in a first direction which extends from the front side surface toward the back side surface, a downward slope falling from the top surface in the first direction, and a groove, the groove formed by a recessed part of the top portion, the groove extends in the first direction over the downward slope from the upward slope, the light diffusing portion is positioned inside the groove and has a mountain-like cross-sectional shape with a peak in the first direction, and the light diffusing portion includes a first surface facing the front side surface which is one inclined surface of the mountain-like shape and a second surface facing the back side surface which is another inclined surface of the mountain-like shape.

2. The image forming apparatus according to claim 1, wherein a display panel is placed on the upward slope.

3. The image forming apparatus according to claim 1, wherein the light guide has a base portion into which light emitted by the light source is incident, an end portion that functions as a light diffusing portion which diffuses the light outward, and a body portion that connects the base portion to the end portion, the protruding housing has an opening in or near the top portion, and the end portion is exposed outward through the opening, and the body portion is covered by the protruding housing.

4. The image forming apparatus according to claim 3, wherein the light source is a light emitting diode lamp formed by molding a light emitting diode chip, the image forming apparatus further comprises a printed circuit board having the light emitting diode lamp mounted thereon, the printed circuit board is covered by the protruding housing, with a mounting surface thereof for mounting the light emitting diode lamp facing upwardly, the opening of the protruding housing is positioned directly above the mounting position of the light emitting diode lamp, and the light guide is a rod-like member linearly extending in an up-down direction, and the rod-like member has the base portion and the end portion at a lower end thereof and an upper end thereof, respectively.

5. The image forming apparatus according to claim 4, further comprising a supporting member located on the printed circuit board and configured to support the light guide, wherein the supporting member is a cylindrical body surrounding the light emitting diode lamp, and a lower end of the cylindrical body is in contact with the mounting surface of the printed circuit board and an upper end of the cylindrical body holds the base portion of the light guide.

6. The image forming apparatus according to claim 4, wherein there are a plurality of light emitting diode lamps, there are a plurality of light guides, and the light guides are arranged to correspond to the respective light emitting diode lamps, and the light guides are connected together by at least one joint member to form a single unit.

7. An image forming apparatus comprising:

an image forming section configured to perform image formation on a sheet;

a body housing formed by a box body with a top surface and a back side surface, a front side surface, a left side surface and a right side surface and configured to contain the image forming section;

a protruding housing located on the top surface and having a top portion protruding upwardly above the top surface;

a light diffusing portion disposed in the protruding housing;

a light source located inside the body housing or the protruding housing and configured to emit light;

a light guide configured to guide light emitted by the light source to the light diffusing portion; and a control unit configured to control illumination of the light source depending on a state of the image forming apparatus, wherein the light diffusing portion is formed by a transparent member having a light diffusing surface for diffusing the light outwardly, the protruding housing includes an upward slope raised to the top portion in a first direction which extends from the front side surface toward the back side surface, a downward slope down from the top surface in the first direction, and a groove, the groove formed by a recessed part of the top portion, the groove extends in the first direction over the downward slope from the upward slope, the protruding housing includes a first side surface located on a side of the right side surface, a second side surface located on a side of the left side surface, and the top surface extends from the first side surface to the second side surface, the shape of the top surface is same from the first side surface to the second side surface, and the light diffusing portion is positioned inside the groove.

8. The image forming apparatus according to claim 7, wherein the protruding housing further has a rectangular display panel incorporated in the upward slope, and an upper edge of the display panel and the light diffusing portion is apart in the first direction, and a space between the upper edge of the display panel and the light diffusing portion is covered by the protruding housing.

9. The image forming apparatus according to claim 7, wherein the light guide has a base portion into which light emitted by the light source is incident, an end portion that functions as a light diffusing portion which diffuses the light outward, and a body portion that connects the base portion to the end portion, the protruding housing has an opening in or near the top portion, and the end portion is exposed outward through the opening, and the body portion is covered by the protruding housing.

10. The image forming apparatus according to claim 9, wherein the light source is a light emitting diode lamp formed by molding a light emitting diode chip, the image forming apparatus further comprises a printed circuit board having the light emitting diode lamp mounted thereon, the printed circuit board is covered by the protruding housing, with a mounting surface thereof for mounting the light emitting diode lamp facing upwardly, the opening of the protruding housing is positioned directly above the mounting position of the light emitting diode lamp, and the light guide is a rod-like member linearly extending in an up-down direction, and the rod-like member has the base portion and the end portion at a lower end thereof and an upper end thereof, respectively.

11. The image forming apparatus according to claim 10, further comprising a supporting member located on the printed circuit board and configured to support the light guide, wherein the supporting member is a cylindrical body surrounding the light emitting diode lamp, and a lower end of the cylindrical body is in contact with the mounting surface of the printed circuit board and an upper end of the cylindrical body holds the base portion of the light guide.

12. The image forming apparatus according to claim 10, wherein there are a plurality of light emitting diode lamps, there are a plurality of light guides, and the light guides are arranged to correspond to the respective light emitting diode lamps, and the light guides are connected together by at least one joint member to form a single unit.

13. An image forming apparatus comprising:

an image forming section configured to perform image formation on a sheet;

a body housing formed by a box body with a top surface and configured to contain the image forming section;

a protruding housing extending higher than the top surface, the protruding housing having an upward slope rising from a front side surface to a back side surface and a top portion formed by a convex surface;

a light diffusing portion disposed in the protruding housing;

a light source located inside the body housing or the protruding housing and configured to emit light;

a light guide configured to guide light emitted by the light source to the light diffusing portion; and a control unit configured to control illumination of the light source depending on a state of the image forming apparatus, wherein the top portion is in the highest position of the image forming apparatus, the light diffusing portion is formed by a transparent member having a light diffusing surface for diffusing the light outwardly, the protruding housing has a groove, the groove formed by a recessed part of the top portion, the light diffusing portion is positioned inside the groove, the light guide has an engagement portion and the protruding housing has a pressing portion, and the pressing portion, so as to achieve the positioning in the vertical direction of the light guide, regulates the engagement portion.

14. The image forming apparatus according to claim 13, wherein the light diffusing surface has cut surfaces for refracting light and diffusing the light outward.

15. The image forming apparatus according to claim 13, wherein the protruding housing has a mountain-like shape formed by the top portion and inclined surfaces located below the top portion, and a display panel is placed on the inclined surface.

16. The image forming apparatus according to claim 13, wherein the light guide has a base portion into which light emitted by the light source is incident, an end portion that functions as a light diffusing portion which diffuses the light outward, and a body portion that connects the base portion to the end portion, the protruding housing has an opening in or near the top portion, and the end portion is exposed outward through the opening, and the body portion is covered by the protruding housing.

17. The image forming apparatus according to claim 16, wherein the light source is a light emitting diode lamp formed by molding a light emitting diode chip, the image forming apparatus further comprises a printed circuit board having the light emitting diode lamp mounted thereon, the printed circuit board is covered by the protruding housing, with a mounting surface thereof for mounting the light emitting diode lamp facing upwardly, the opening of the protruding housing is positioned directly above the mounting position of the light emitting diode lamp, and the light guide is a rod-like member linearly extending in an up-down direction, and the rod-like member has the base portion and the end portion at a lower end thereof and an upper end thereof, respectively.

18. The image forming apparatus according to claim 17, further comprising a supporting member located on the printed circuit board and configured to support the light guide, wherein the supporting member is a cylindrical body surrounding the light emitting diode lamp, and a lower end of the cylindrical body is in contact with the mounting surface of the printed circuit board and an upper end of the cylindrical body holds the base portion of the light guide.

19. The image forming apparatus according to claim 17, wherein there are a plurality of light emitting diode lamps, there are a plurality of light guides, and the light guides are arranged to correspond to the respective light emitting diode lamps, and the light guides are connected together by at least one joint member to form a single unit.

* * * * *